United States Patent [19]

Gaitten et al.

[11] 4,207,059

[45] Jun. 10, 1980

[54] BACKUP ROLL FOR HEATED FUSER SYSTEM

[75] Inventors: Ronald E. Gaitten, Boulder; Paul D. Jachimiak, Lafayette; James A. Machmer, Boulder, all of Colo.; Alvin L. Wittwer, Paris, Ky.

[73] Assignee: International Business Machines Corporation, Armond, N.Y.

[21] Appl. No.: 639,824

[22] Filed: Dec. 11, 1975

[51] Int. Cl.[2] ..... G03G 13/20; H05B 1/00

[52] U.S. Cl. ..... 432/60; 219/469; 29/132

[58] Field of Search ..... 432/59, 60, 227, 228; 219/469, 216; 29/130, 132; 100/93 RP

[56] References Cited

U.S. PATENT DOCUMENTS

| | | | |
|---|---|---|---|
| B 425,770 | 1/1975 | Thettu | 29/132 |
| 3,435,500 | 4/1969 | Aser et al. | 432/60 |
| 3,449,548 | 6/1969 | Adamek et al. | 219/469 |
| 3,490,119 | 1/1970 | Fukuyama et al. | 29/130 |
| 3,809,854 | 5/1974 | Sanders | 432/60 |
| 3,844,252 | 10/1974 | Thettu | 432/60 |
| 3,849,062 | 11/1975 | Thettu et al. | 432/60 |
| 3,858,287 | 1/1975 | Christoffersen | 29/132 |
| 3,868,744 | 3/1975 | Thettu | 432/60 |
| 3,912,901 | 10/1975 | Strella et al. | 432/60 |
| 3,942,230 | 3/1976 | Nalband | 432/60 |
| 3,959,574 | 5/1976 | Seanor et al. | 29/132 |

*Primary Examiner*—Henry C. Yuen

*Attorney, Agent, or Firm*—Pennie & Edmonds

[57] ABSTRACT

An improved backup roll for use in the heated fuser system of electrostatic copy machines wherein the fuser system employs a fuser roll couple comprised of a heated fuser roll in pressure contact with the backup roll. In construction, the backup roll includes an aluminum core member with a coating of polyurethane reinforced flourinated ethylene propylene on its surface. The coating has heat transfer characteristics similar to the copy sheets fed through the couple so as to withdraw heat from the heated fuser roll, along each zone where it may make direct contact with it, at substantially the same rate as the copy sheets withdraw heat. The coating also has a thickness whereby the heat transferred to each zone during contact with the fuser roll is quickly transferred to the aluminum core before that zone again contacts the fuser roll.

12 Claims, 1 Drawing Figure

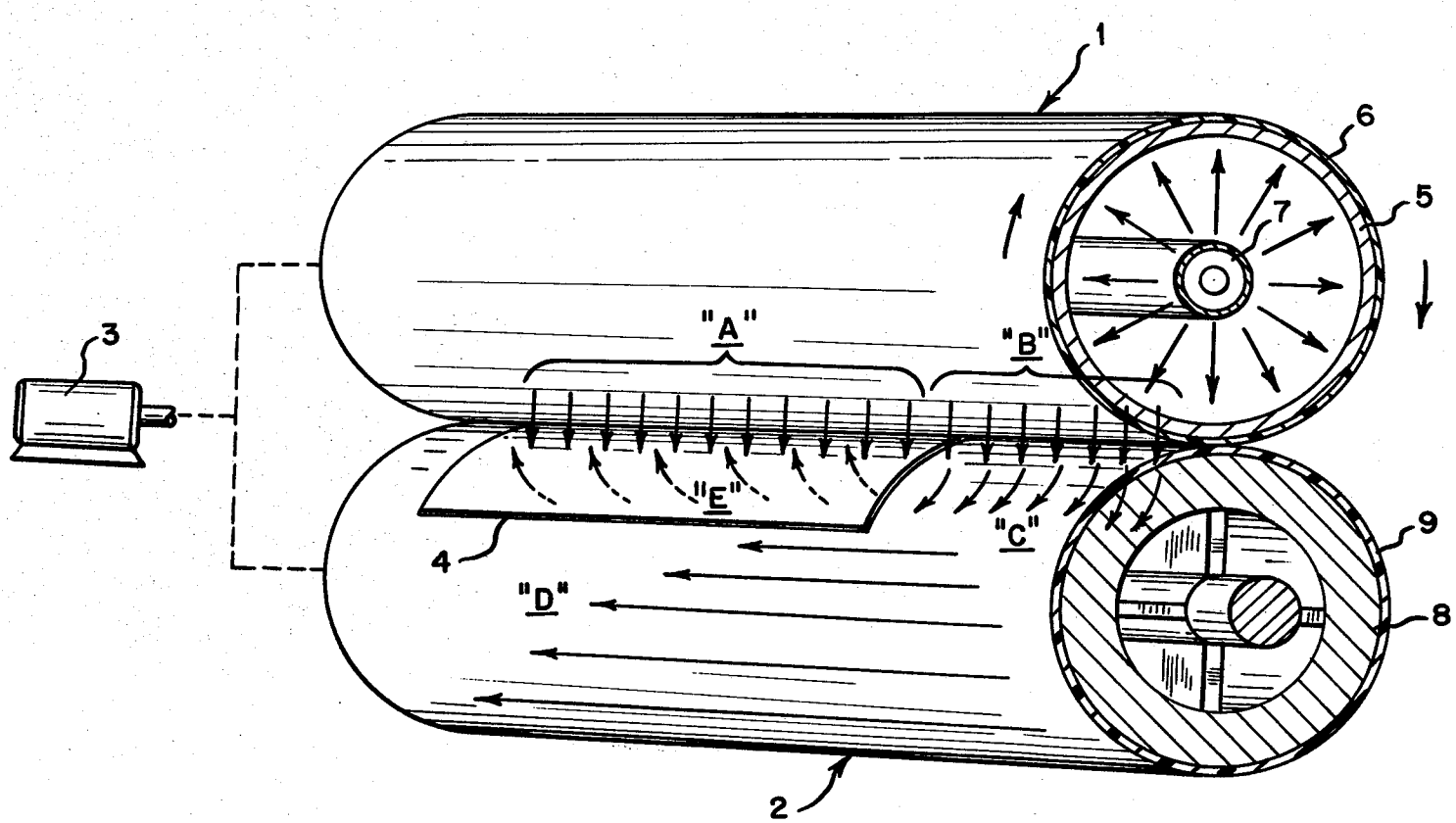
1
2
3
4
5
6
7
8
9
"A"
"B"
"C"
"D"
"E"

BACKUP ROLL FOR HEATED FUSER SYSTEM

BACKGROUND OF THE INVENTION

Heated fuser systems are used in electrostatic copy machines for fixing the thermoplastic image onto the copy sheets, such as paper, which are fed through the machine. The images are fixed by heat and pressure as the copy sheets pass between the heated fuser roll and the backup roll of the fuser roll couple. The heated fuser roll presses against the powdered side of the copy sheets while the backup roll provides a support for the sheets during this operation. In order to assure proper fixing of the images onto the copy sheets, it is necessary that the temperature of the fuser roll be maintained within restricted limits; and of particular importance, is the temperature profile of the fuser roll along the surface of the roll. The temperature from place to place along the surface of the roll must be kept uniform in order to assure acceptable fuse quality of the entire image and acceptable release reliability of the fused image from contact with the fuser roll as the copy sheets leave the couple.

As paper copy sheets are fed between the heated fuser roll and backup roll, they absorb heat from the fuser roll. Generally, the paper is fed through the roll couple in sidewise fashion; that is, with the length of the paper oriented parallel to the longitudinal axis of the fuser and backup rolls. In an electrostatic copy machine constructed for use with paper of uniform length, the length of the fuser roll and backup roll will be tailored to that of the paper. Thus, in operation, the fuser roll will be subjected to uniform heating and cooling conditions along its entire length. More specifically, the heat extracted from the fuser roll by the paper will be uniform along the axial length of the fuser roll. Also since the thermal characteristics of the paper are such as to effectively insulate the backup roll from the fuser roll, the temperature of the backup roll will remain essentially constant.

In machines adapted for use with paper of different shapes or sizes, as for example, paper of different lengths, the fuser roll couple will have a length sufficient to accomodate the longest paper size. With the paper fed through the fuser roll couple in sidewise fashion, the long paper will assure a uniform temperature profile along the length of the roll couple. Short paper, on the other hand, will leave one or both ends of the fuser roll exposed for direct contact with the backup roll. Where this happens, the backup roll will extract heat from the fuser roll at a rate determined by its own thermal characteristics. Normally, with conventional constructions of backup rolls, the heat so removed will not be at the same rate as that removed along the axial length of the fuser roll where paper is being fed through the couple. Thus, the temperature profile along the length of the fuser roll will not be maintained uniform. The direct contact of the fuser roll with the backup roll will also heat the end or ends of the backup roll along incremental zones as direct nip contact is made with the fuser roll. Heat will tend to collect in these zones so that as they again come into nip contact with the fuser roll, they will be hotter than the previous time and therefore not able to extract as much heat as the previous time. Thus, not only may a different quantity of heat be removed from the ends of the fuser roll, due to direct contact with the backup roll, than is extracted by the paper, the amount of heat extracted at the roll ends will vary each time each zone on the backup roll makes repeated contact with the fuser roll.

In machines constructed for use with paper of different lengths, attempts have been made to prevent the creation of any temperature differential along the axial length of the fuser roll. As an example, it has been proposed to add separate temperature control devices for maintaining the temperature of the fuser roll uniform throughout its length. Such devices are, however, generally expensive and add to the bulk of the machine. Such devices also require additional controls for activating them at the appropriate time when short paper is being fed through the machine and for deactivating them when long paper is used. Another approach which has been suggested is the use of a dual length heating element for heating the fuser roll. With a dual length heating element, the fuser roll would be heated along a length corresponding to the length of the paper being fed through the fusing couple. Again, such a device requires controls for activating it at the appropriate time. It also adds to the overall cost of the machine and presents structural problems.

SUMMARY OF THE INVENTION

In accordance with the teachings of the present invention, an improved backup roll is employed in the fuser roll couple for properly extracting heat from the fuser roll wherther or not paper being fed through the couple engages along the entire surface of the fuser roll. Generally, the backup roll is constructed of a core member of heat conductive material and a heat insulative coating is provided on the surface of the core member in at least the areas where it may make direct contact with the heated fuser roll. In the presently preferred embodiment, the backup roll is constructed of an aluminum core member and coated over its entire outer surface with polyurethane reinforced fluorinated ethylene propylene.

The heat conductive coating has heat transfer characteristics and is of a prescribed thickness whereby the heat which is transferred from the heated fuser roll to each incremental zone of the coating making direct nip contact therewith is at the same rate as extracted by the paper and is quickly passed through the coating to the underlying core member of the backup roll. In the preferred embodiment, the thickness of the coating is about 4 mils and the thickness of the aluminum core about ½ inch. With the coating of prescribed thickness, the proper rate of heat transfer is assured; and with the core constructed of aluminum, the heat from the coating is readily absorbed. Also, with the aluminum core of substantial thickness, the heat transferred to its end or ends is permitted to flow axially to the portion underlying the paper and thus even out its axial temperature profile. Such heat can then be transferred to the back side of the paper and removed from the machine with the paper.

By having the coating of the backup roll and the paper remove heat at the same rates and by assuring that the heat transferred to each zone of the backup roll will be dissipated before that zone again contacts the fuser roll, the temperature profile of the fuser roll along its axial length may be maintained uniform during operation of the machine even though the fuser roll is not in full engagement with paper along its entire axial length. Of further significance is the fact that the results obtained with applicants' invention are possible without the need for any additional temperature gradient control devices for regulating the axial temperature gradient of the fuser roll and/or the backup roll.

In addition to the heat transfer characteristics of the improved backup roll of the present invention, the coating itself is one which is thermally stable at the operating temperatures of the fuser system. It also possesses low surface energy so as to minimize adhesion of any thermoplastic powder thereto. Further, it possesses abrasive characteristics which resist wear so as to provide a smooth surface and uniform thickness assuring proper operation of the machine.

BRIEF DESCRIPTION OF THE DRAWING

FIG. 1 is a perspective view of the fuser roll couple showing the construction of the improved backup roll of the present invention and the heat flow patterns through the couple.

DETAILED DESCRIPTION OF THE PREFERRED EMBODIMENT

As shown in FIG. 1, the fuser system includes a fuser roll couple comprised of a fuser roll 1 and a backup roll 2. As is conventional, the rolls are mounted for rotation in opposite directions with the fuser roll in pressure contact with the backup roll and driven by suitable means shown at 3. Sheets, such as paper 4, are fed into the nip between the rolls to fix the thermoplastic image thereto.

In construction, the fuser roll may include a thin substantially rigid cylindrical wall 5 made of good heat conductive material such as aluminum. The surface of the cylindrical wall is provided with a smooth thin layer of silicone elastomer 6 such as General Electric RTV60 which is resistant to heat degradation and deformable under pressure engagement with the backup roll. The fuser roll is heated by a heating element 7 extending axially through the interior of the roll.

In accordance with the teachings of the present invention, the backup roll 2 is constructed of a core member 8 having good heat conductive characteristics. As shown, the core member is cylindrical in shape and has an internally vaned construction. In the preferred embodiment of the invention, the core member is constructed of aluminum with a wall thickness of about ½ inch.

The outer cylindrical surface of the core member is coated with a heat insulative coating 9. In the preferred construction, this coating covers the entire outer surface of the core member and is of polyurethane reinforced fluorinated ethylene propylene. Such a coating material is manufactured by the Dupont Corporation as Dupont 958-200 Series Teflon-S.

The coating material is chosen for its heat transfer characteristics; and more particularly, in accordance with the teachings of the present invention, it is one that has heat transfer characteristics that are substantially the same as those of the paper copy sheets fed through the fuser couple. In determining the necessary characteristics of the coating, the thermal properties of the paper and, in particular, its heat transfer characteristics in relation to the heated fuser roll and backup roll are first determined. In doing this, certain physical characteristics of the paper are combined into a formula to give a representation of the heat which the paper is capable of extracting from the heated fuser roll. This combined characteristic is defined as "heat-get-ability" or the "heat-give-up-ability". Either term may be used; however, it will be understood that when a measurement of the heat being received by the body is being determined rather than that being given up, the term "heat-get-ability" may be preferred, and vice versa. "Heat-get-ability" is defined by the equation:

$$\delta = \sqrt{k\rho C_p} \tag{1}$$

where:

k is thermal conductivity as expressed in BTU/(hr) (ft) (°F.), $\rho$ is density as expressed in lb/ft$^3$, and $C_p$ is specific heat as expressed in BTU/(lb) (°F).

The values of these properties for paper do not vary greatly with the types of paper readily available and used in electrostatic copy machines. Typically, the paper will have a thermal conductivity of 0.075, a specific heat of 0.40 and a density of 44. Using these values in equation (1) above, the heat-get-ability of the paper is determined as being 1.15 BTU/(°F.) (ft$^2$) (hr$^{\frac{1}{2}}$).

Using this characteristic of the paper, that is its heat-get-ability, it is then possible to calculate the heat which is transferred from the heated fuser roll to the paper during contact of each incremental zone of finite area of the paper as it passes between the fuser roll and backup roll. This heat transfer is determined by the equation:

$$H_{f\to s} = \frac{2\theta^{\frac{1}{2}}(T_f - T_s)(\delta_f \delta_s)}{\pi(\delta_f + \delta_s)} \quad \frac{\text{BTU}}{(\text{ft}^2)} \tag{2}$$

where:

$T_f$ is the surface temperature of the elastomer layer on the fuser roll, $T_s$ is the temperature of the paper entering the nip, $\delta_f$ is the heat-give-up-ability of the the elastomer 6 of the fuser roll, $\delta_s$ is the heat-get-ability of the paper, and $\theta$ is the nip resistance time.

With the electrostatic copy machine running at a steady state condition, that is after it has been warmed up, the values for the above characteristics would be about as follows: $T_f = 360°$ F., $\delta_f = 2.50$ and $\theta = 5 \times 10^{-6}$ hr. Using these values in the equation (2) above, it is determined that the heat transferred from the heated fuser roll to the paper is 0.54 BTU/(ft$^2$). The heat transferred from the fuser roll to the paper is represented in FIG. 1 by the arrows A.

In determining the heat transferred between the heated fuser roll and the coating on the backup roll, it is necessary to recognize that the backup roll, during the steady running state of the machine, is relatively warm and about twice the temperature of the paper. The actual temperature of the backup roll as it approaches direct nip contact with the fuser roll may be determined through conventional procedures as being about 180° F. This is a bulk temperature reading of the backup roll and applies both to the cylindrical core and the coating. In order for this relatively warm coating to extract heat from the fuser roll, which is operatively at approximately 360° F., at a rate which will simulate the paper. The heat-get-ability of the coating must be slightly greater than that of the paper. With the preferred coating of the present invention, that is with the Dupont 985-200 Series Teflon-S, the heat-get-ability ($\delta_c$) is calculated at 1.97. This value is arrived at through use of the equation (1) wherein $k_c = 0.14$, $Cp_c = 0.25$ and $\rho_c = 109.8$.

Using this value of $\delta_c = 1.97$ and 180° F. for the temperature of the coating ($T_c$) in the heat transfer equation (2), it is determined that the heat transferred from the heated fuser roll to each zone of the coating on the backup roll as it makes direct nip contact with the fuser roll is equal to 0.50 BTU/(ft$^2$). Within the practical limitations of the operating conditions of the machine, this rate of heat transfer is considered to be substantially the same as the rate of heat transferred from the fuser roll to the paper. In this regard it will be noted that under normal operation conditions of the machine, the individual values of the characteristics used in determining heat transfer may vary.

For the above heat transfer equation (2) to be valid, the two bodies between which the heat is being transferred must be in perfect contact. Also, the bodies must be laterally homogeneous to provide a one dimension flow of heat. Finally, the bodies must be infinite in thickness in the direction of heat flow for the period of time over which the heat flow is measured. This last requirement as to thickness dictates a minimum thickness for the coating material. In order to obtain a negligible error in the heat transfer equation (2), the minimum thickness of the coating is derived by the following equation:

$$th = 1.5\left[\frac{2k_c\theta}{\rho_c C_{pc}}\right]^{\frac{1}{2}} \quad (3)$$

Substituting the values for the coating material into the above equation, it is determined that the minimum thickness of the coating required is 4 mils.

In addition to having a coating of minimum thickness in order to be able to use the heat transfer equation (2) in determining the rate of heat transfer between the fuser roll and either the paper or the backup roll, it is necessary that the coating not be too thick. An upper limit on the coating thickness is necessary in order to assure that the heat transferred to each zone of the coating during direct nip contact with the fuser roll is passed through the coating to the interface between the coating and the cylindrical core of the backup roll. This is important in making certain that the heat absorbed into any particular zone of the coating during its most recent nip contact is dissipated from the coating before the particular zone again comes into direct nip contact with the fuser roll. During the operation of the machine, a small portion of the heat in the coating is dissipated to air. The vast majority of it, however, is transferred to the aluminum core member. In FIG. 1 of the drawings, the heat transferred from the fuser roll directly to the coating on the backup roll is indicated by the arrows B while the heat transferred from the coating to the inner cylindrical core of the backup roll is indicated by the arrows C. If the coating on the backup roll is too thick, the heat transferred to each zone of the coating during direct nip contact with the fuser roll will not be passed to the aluminum core member. Instead, it will be retained in the coating and the surface temperature will remain relatively high. In practice, applicants have found that a maximum coating of 4.5 mils, when the backup roll makes from 50 to 100 nip contacts per minute is acceptable. The upper limit to the thickness of this coating may be somewhat higher than this; but in using thicker coatings, the requirement of complete heat dissipation from the coating to the aluminum core must be kept in mind.

With respect to the coating thickness required in accordance with the preferred construction of the present invention, it may be noted that prior art backup roll constructions have suggested the use of a Teflon coating. However, the coating with the prior art constructions has been for the purpose of providing a non-tacky surface and this has been accomplished by a coating which is thick enough to simply cover the surface of the backup roll. With spray coating techniques, this can be done with a thickness of 1 mil or less. For the reasons discussed above, it will be apparent that using a coating of this thickness without regard to other characteristics of the coating and core member would not satisfy the requirements of applicants' invention.

Once the heat from the coating is transferred to the aluminum core of the backup roll, it can again be brought into nip contact with the fuser roll and simulate paper to withdraw heat from the fuser roll at the same rate as paper. Under the typical operating conditions of the fuser system, the circumferential width of each incremental zone on the coating of the backup roll as it makes nip contact is on the order of 0.200 inch and the speed of movement of the coating through nip contact is about 11½ inches per second. With the fuser system having a backup roll and operating as described above, each zone, after making direct nip contact with the fuser roll, will remain out of contact with the fuser roll for about 50 times as long as the nip duration time. This gives more than adequate time for the necessary heat dissipation. Actually, the removal of heat from the coating to the backup roll, which begins after nip contact, is substantially completed by the time the backup roll has rotated through about 120°.

In addition to the heat transfer characteristics of the coating used in the present invention, the preferred coating has other physical characteristics which further assure proper operation of the machine. First, the coating possesses a low surface energy and thereby minimizes the chances of any thermoplastic powder adhering thereto. Secondly, the coating is stable at the operating temperatures of the machine. As indicated above, the bulk temperature of the coating and backup roll is about 180° F. when out of nip contact with the fuser roll. When in nip contact, the coating is exposed to an interface temperature of about 280° F. This interface temperature is determined by the equation:

$$T\,(\text{interface}) = \frac{(T_f)(\delta_f) + (T_c)(\delta_c)}{\delta_f + \delta_c} \quad (4)$$

The coating used in accordance with the teachings of the present invention also has an abrasive characteristic which makes it resistant to wear. This is important in that fuser systems of this type typically include a scraper blade engaging lightly against the backup roll surface for removing any thermoplastic powder which may be on the surface. The use of the scraper blade produces an abrasive action against the coating surface. Also, the coating is subjected to abrasive wear by the paper itself. With the preferred coating, deterioration thereof due to wear is avoided.

Finally, with the cylindrical core having a substantial thickness of about ½ inch, the heat which is transferred to the core at the exposed end or ends is readily able to flow axially through the core. This heat flow is represented in FIG. 1 by the arrows D and has the effect of evening out the temperature profile of the core. In addition, the heat flow directs the heat which is received from the fuser roll to the back side of the paper. This heat flow is represented by the arrows E in FIG. 1. An advantage of this heat flow pattern is that the heat which is transferred to the paper will be removed from the machine upon removal of the paper.

We claim:

1. In a heated fuser system for fusing images on copy sheets and including a fuser roll couple having a heated fuser roll and a backup roll disposed in pressure contact therewith to form a nip for receiving copy sheets fed therebetween with the sheets leaving a portion of the backup roll in direct nip contact with the heated fuser roll, and means for rotating said rolls in direct nip contact with each other whereby at any point in time the direct nip contact is defined by the engagement of the fuser roll with a zone on the backup roll of finite area, an improved backup roll comprising:

(a) a core member constructed of heat conductive material; and (b) a heat insulative coating on the surface of the core member in the area of direct contact with the heated fuser roll, (1) said coating having heat transfer characteristics whereby heat is transferred from the heated fuser roll to the coating during direct nip contact of each successive zone therewith, (2) said coating having a maximum thickness of about 4.5 mils whereby the heat transferred to each successive zone from the heated fuser roll duing direct nip contact is, less the amount of heat dissipated to air, passed through said zone to the interface between the coating and the underlying core member before the next successive direct nip contact of said zone with the heated fuser roll, (3) said coating having a minimum thickness about equal to $$1.5\left[\frac{2k_c\theta}{\rho_c C_{pc}}\right]^{\frac{1}{2}}$$

where:

k=thermal conductivity BTU/(hr) (ft) (°F.)

sub c=backup roll coating $\theta$=nip resistance time in hours of each successive zone of contact of fuser roll with coating on backup roll or paper $\rho$=density lb/ft$^3$ $C_p$=specific heat BTU/(lb) (°F.), and (4) said core member having heat transfer characteristics whereby the heat passed through each successive zone to the interface of the coating and the core member is absorbed by the core member before that zone again moves into direct nip contact.

2. An improved backup roll as defined in claim 1 wherein:

(a) the coating material has heat transfer characteristics whereby the heat transferred from the heated fuser roll to the coating and to the copy sheets is substantially equal when defined by the equations:

$$H_{f\to c}=\frac{2\theta^{\frac{1}{2}}(T_f-T_c)(\delta_f\delta_c)}{\sqrt{\pi}\,(\delta_f+\delta_c)}\ \frac{\text{BTU}}{(\text{ft})^2}\ \text{and}$$

$$H_{f\to s}=\frac{2\theta^{\frac{1}{2}}(T_f-T_s)(\delta_f\delta_s)}{\sqrt{\pi}\,(\delta_f+\delta_s)}\ \frac{\text{BTU}}{(\text{ft}^2)}$$

where:

T=Temperature °F $\Theta$=nip resistance time in hours of each successive zone of contact of fuser roll with coating on backup roll or paper $\delta$=heat give-up-ability (heat-get-ability)

$$\frac{\text{BTU}}{(°\text{F.})\,(\text{ft}^2)\,(\text{hr}^{\frac{1}{2}})}=\sqrt{k\rho C_p}$$

where:

k=thermal conductivity BTU/(hr) (ft) (°F.)

$C_p$=specific heat BTU/(lb) (°F.)

$\rho$=density lb/ft$^3$ sub f=fuser roll sub s=copy sheet sub c=backup roll coating.

3. An improved backup roll as defined in claim 1 for use in a fuser system where at its steady state running condition $T_f \simeq 360$, $T_s \simeq 90$, $T_c \simeq 180$, $\delta_f \simeq 2.50$, $\delta_s \simeq 1.15$ and $\delta \simeq 1.97$ where:

T=Temperature °F.

$\delta$=heat give-up-ability (heat-get-ability)

$$\frac{\text{BTU}}{(°\text{F.})\,(\text{ft}^2)\,(\text{hr}^{\frac{1}{2}})}=\sqrt{k\rho C_p}$$

sub f=fuser roll sub s=copy sheet sub c=backup roll coating.

4. An improved backup roll as defined in claim 3 wherein:

(a) the thermal conductivity of the coating ($k_c$) is about 0.14;

(b) the specific heat of the coating ($C_{pc}$) is about 0.25; and (c) the density of the coating ($\rho_c$) is about 109.8.

5. An improved backup roll as defined in claim 4 wherein:

(a) the core member is constructed or rigid heat conductive metal; and (b) the heat conductive coating covers the entire surface of the core member where it is to be contacted by the fuser roll and the copy sheets.

6. An improved backup roll as defined in claim 5 wherein:

(a) the core member is constructed of aluminum; and (b) the heat insulative coating is a fluorinated ethylene propylene Teflon.

7. An improved backup roll as defined in claim 6 wherein:

(a) the coating is polyurethane reinforced fluorinated ethylene propylene Teflon.

8. An improved backup roll as defined in claim 7 wherein:

(a) the core member is cylindrical in construction with a wall thickness of about ½ inch.

9. In a heated fuser system for fusing images on copy sheets and including a fuser roll couple having a heated fuser roll and a backup roll disposed in pressure contact therewith to form a nip for receiving copy sheets fed therebetween with the sheets leaving a portion of the backup roll in direct nip contact with the heated fuser roll, and means for rotating said rolls in direct nip contact with each other whereby at any point in time the direct nip contact is defined by the engagement of the fuser roll with a zone on the backup roll of finite area and wherein, at the steady state running condition of the system, the fuser roll, backup roll, and copy sheet temperatures are about 360° F., 180° F. and 90° F., respectively and the copy sheets have a heat-get-ability ($\delta_s$) of about 1.15 according to the equation: $\delta_s=\sqrt{k_s\rho_s C_{ps}}$ where $k_s$ is the thermal conductivity of the paper BTU/(hr) (ft) (°F.), $\rho_s$ is its density lb/ft$^3$, and $C_{ps}$ is its specific heat BTU/(lb) (°F.), an improved backup roll comprising:

(a) a core member constructed of aluminum; and (b) a heat conductive coating on the cylindrical surface of the core member in the area of direct contact with the heated fuser roll, (1) said coating being a fluorinated ethylene propylene Teflon, and (2) said coating having a thickness of between about 4 and 4.5 mils.

10. An improved backup roll as defined in claim 9 wherein:

(a) the coating is polyurethane reinforced fluorinated ethylene propylene Teflon.

11. An improved backup roll as defined in claim 10 wherein:

(a) the coating has a thickness of about 4 mills.

12. An improved backup roll as defined in claim 11 wherein:

(a) the core member is cylindrical in construction with a wall thickness of about ½ inch.

* * * * *